United States Patent [19]

Laimer et al.

[11] 4,129,288

[45] Dec. 12, 1978

[54] HOOD TO BE USED IN A METAL PRODUCTION PLANT

[75] Inventors: Friedrich Laimer, Perg; Peter Moser, Linz, both of Austria

[73] Assignee: Vereinigte Österreichische Eisen-und Stahlwerke - Alpine Montan Aktiengesellschaft, Linz, Austria

[21] Appl. No.: 877,242

[22] Filed: Feb. 13, 1978

[30] Foreign Application Priority Data

Feb. 28, 1977 [AT] Austria ..... 1313/77

[51] Int. Cl.[2] ..... C21C 5/40

[52] U.S. Cl. ..... 266/158

[58] Field of Search ..... 75/60; 98/115 R, 115 VM; 266/142, 143, 158

[56] References Cited

U.S. PATENT DOCUMENTS 3,791,638 2/1974 Evans ..... 266/158

*Primary Examiner*—Gerald A. Dost

*Attorney, Agent, or Firm*—Brumbaugh, Graves, Donohue & Raymond

[57] ABSTRACT

A hood for diverting the flue gases and smoke when pouring molten metal from a tiltable metallurgical vessel into a ladle hanging from a crane, has an opening through which the vessel lip projects into the hood interior, at least one recess through which the ladle carrying means can be moved, and a structure that covers the ladle mouth and the carrying means on all sides.

7 Claims, 3 Drawing Figures

HOOD TO BE USED IN A METAL PRODUCTION PLANT

BACKGROUND OF THE INVENTION

The invention relates to a hood for diverting the flue gases and smoke when pouring molten metal, in particular pig iron or steel, from a tiltable metallurgical vessel into a ladle hanging from a crane.

When pouring pig iron from a tiltable pig iron mixer into a ladle, much smoke will be formed when the pig iron stream comes in touch with the ladle.

With ladles that are hung from the crane and are placed on the floor or into a pit, respectively, while they are filled, heavy splashing will occur as well as a temperature loss. Also the ladle lining will be strongly worn, due to the great fall height of the pig iron, particularly when the mixer is completely filled. For these reasons, efforts have been made to pour the pig iron into a ladle located closely below the lip of the pig iron mixer. Since the position of the lip depends on how full the tiltable mixer is, it is advantageous to pour the pig iron into a ladle hanging from a crane. In this way, the ladle can also follow the movement of the lip that is necessary during pouring from one vessel into the other. Due to the different positions and movements of the lip and the ladle, it has not been possible so far to controllably divert the flue gases and smoke emerging during pouring, so that the environment has hitherto been polluted during pouring.

The same problem arises when pouring molten metal from a tiltable metallurgical furnace, for instance when pouring steel from a O.H.-tilting furnace or a tiltable arc furnace into a ladle hanging from a crane.

SUMMARY OF THE INVENTION

The invention aims at avoiding these difficulties and has as its object to create a hood with which the smoke and flue gas are effectively seized during pouring from one vessel into the other, whereby a ladle hanging from the crane can be held, all the time, at a short distance below the lip of the metallurgical vessel, thus allowing the ladle to follow the movement or the vessel lip.

This object is achieved according to the invention in that the hood covers, on all sides, the vessel lip and the carrying device of the crane that guides the ladle, and comprises structure defining an opening on the side toward the metallurgical vessel, through which opening the lip of that vessel projects into the interior of the hood, and a closeable recess provided on the side and on part of the hood ceiling, into and out of which recess the ladle carrying devices can be moved.

Suitably, there are two adjacent recesses in the hood ceiling, into and out of which the carrying ropes of the crane holding the ladle via a crane tie-bar can be moved.

According to a preferred embodiment the recesses are provided on a side wall opposite the wall adjacent the vessel, as well as on a ceiling cover plate of the hood, and are closeable by doors displaceable along this opposite side wall.

In this case, the upper ends of the doors are preferably designed so as to project over the cover plate at an angle, thus covering part of the recesses penetrating the cover plate.

Furthermore, it is of advantage to design the opening for the lip of a pig iron mixer as a vertical slot extending along the tilting path. A wing displaceable along the slot is provided for covering the slot about all the sides of the lip.

BRIEF DESCRIPTION OF THE DRAWINGS

The invention shall now be described in more detail by way of an embodiment and with reference to the accompanying drawings, wherein.

DESCRIPTION OF AN EXEMPLARY EMBODIMENT

Figure 1:
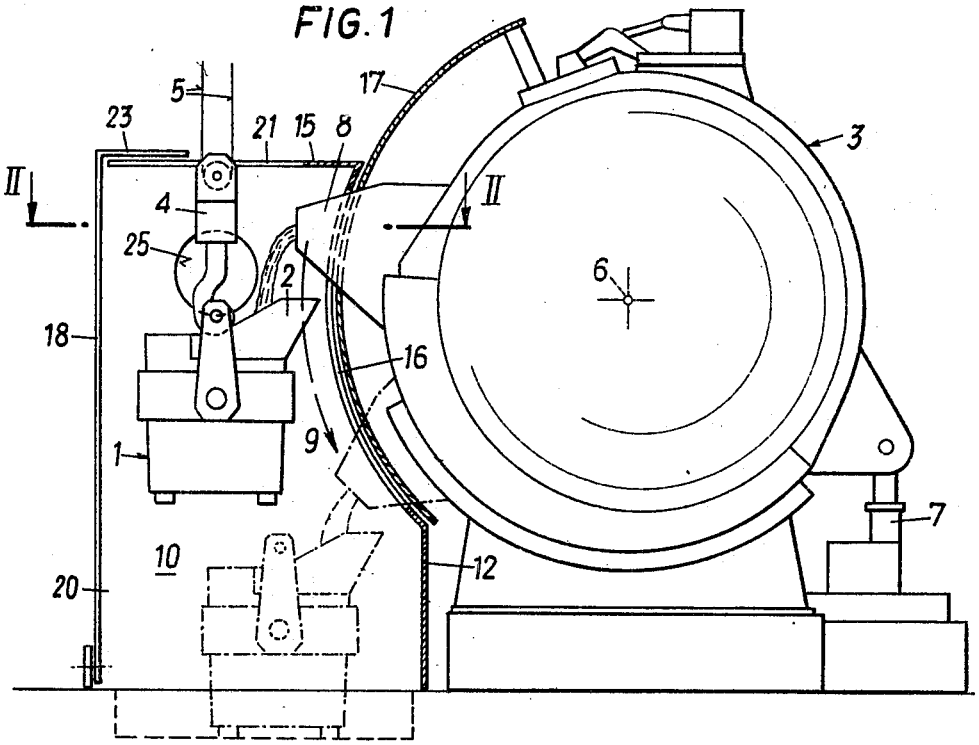
FIG. 1 illustrates a pig iron mixer in side view, with a vertical section of a hood according to the invention, during pouring into a ladle hanging from a crane.

A ladle is denoted by 1, into whose mouth 2 pig iron is poured from a pig iron mixer 3. The ladle 1 is hanging from a crane tie-bar 4 which is suspended from a crane (not illustrated) by ropes 5 and is guided by that crane.

The pig iron mixer 3 is tiltable about its axis 6 by means of a tilting drive 7, its lip 8 moving from the solid-line position of FIG. 1 into the dot-and-dash position. The position of the lip 8 during pouring always depends on the amount of pig iron still present in the mixer 3. The lip thus pivots during pouring, in the direction of the arrow 9, which movement has to be followed by the ladle 1, if the latter is positioned closely below the lip.

As can be seen from FIG. 1, a hood 10 is arranged immediately beside the mixer 3. It comprises four side walls 11, 12, 13, 14 forming a rectangle and is upwardly delimited by a cover plate 15. The side wall 12 adjacent or facing the mixer has a curvature whose axis coincides with the tilting axis 6 of the mixer 3. In this side wall 12 a vertical slot 16 is provided, through which the lip 8 projects into the interior of the hood 10. The part of the slot 16 below and above the lip which remains free is covered by a wing 17, whose curvature corresponds to that of the side wall 12. The wing 17 is fastened on the outer shell of the mixer 3 so as to follow the movement of the lip 8; it could, however, also be guided by means of guides mounted on the side wall 12 and be moved by the lip.

Figure 2:
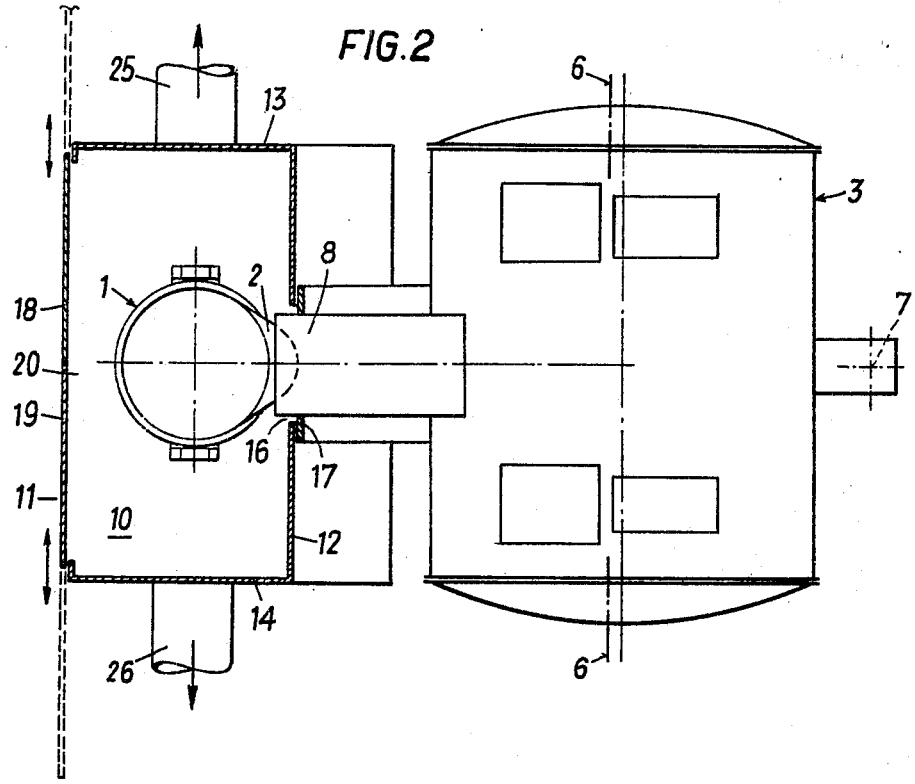
FIG. 2 is a sectional view along line II-II of FIG. 1.
Figure 3:
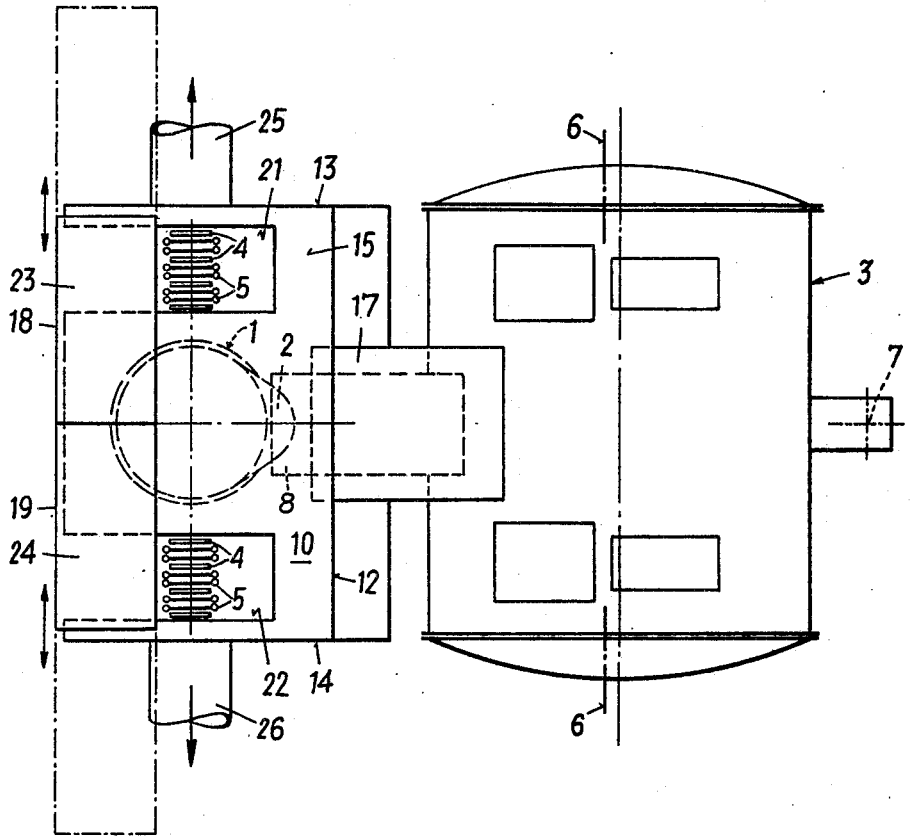
FIG. 3 is a ground plan view of FIG. 1.

The side wall 11 opposite the arcuatedly designed side wall 12 is formed by doors 18, 19 that are displaceable in the direction of the axis 6 of the mixer 3, which doors, in the open position illustrated in FIG. 2 by broken lines, create a recess 20, through which the ladle 1 hanging from the crane tie-bar 4 can be moved into and out of the hood 10. The doors could also be pivotally arranged on the hood 10. The cover plate 15 has two recesses 21, 22 for the carrying ropes 5 holding the crane tie-bar 4. The upper ends 23, 24 of the doors are angled over the cover plate 15, so that part of the recesses 21, 22 of the cover plate are covered. Flue pipes 25, 26 are provided on the side walls 13, 14, which lead to a ventilator as well as to a filter (both not illustrated). The vacuum performance and the sizes of the recesses are coordinated, so that a low pressure area is formed within the chamber when the doors are closed.

Pouring from the mixer into the ladle is effected in the following way: The crane is moved, with the empty ladle, into the opened hood. In the meantime, the mixer, according to the pig iron content, is tilted into such a position that the pig iron is on the verge of running out. The ladle is placed closely below the lip 8, then the doors 18, 19 are closed. By further tilting the mixer, the pig iron is poured into the ladle. The smoke and gases emerging during that procedure are removed through the flue pipes. Lowering of the ladle corresponding to the pivotal movement of the lip during pouring from one vessel into the other can be observed through a lateral opening not illustrated herein or via a television camera also not illustrated herein.

What we claim is:

1. In a hood to be used in a metal production plant of the type including a crane, carrying means arranged on said crane, a ladle having a mouth and being hung from and guided by said carrying means, and a tiltable metallurgical vessel having a lip for pouring out molten metal, said hood having an interior surrounded by a ceiling and side walls and being used for diverting flue gas and smoke emerging while pouring said molten metal from said tiltable metallurgical vessel into said ladle, the improvement comprising an arrangement of the ceiling and side walls such that said hood covers the mouth of said ladle and said carrying means on all sides thereof, said hood being provided, on a first one of said side walls which is adjacent said metallurgical vessel, with an opening, said lip of said tiltable metallurgical vessel projecting into the interior of said hood through said opening, and said hood being provided on one of said side walls and part of said ceiling with a closeable recess, said carrying means with said ladle being movable into and out of said closeable recess.

2. A hood as set forth in claim 1, wherein said molten metal is pig iron.

3. A hood as set forth in claim 1, wherein said molten metal is steel.

4. A hood as set forth in claim 1, wherein said crane includes carrying ropes, said carrying means includes a crane tie-bar, and the part of the recess in said ceiling of said hood includes two adjacent ceiling recesses, said carrying ropes holding said ladle via said crane tie-bar and being movable into and out of said two adjacent recesses.

5. A hood as set forth in claim 4, wherein said ceiling of said hood is designed as a cover plate, said closeable recess in said hood is provided in a second one of said side walls located opposite the first side wall that is adjacent said tiltable metallurgical vessel, and said two adjacent ceiling recesses are provided in said cover plate; and further including doors provided so as to be displaceable along said second one of said side walls for closing said recess in said second side wall and said two adjacent ceiling recesses.

6. A hood as set forth in claim 5, wherein said doors have upper ends, said upper ends being designed so as to project over said cover plate at an angle, thereby covering part of said two adjacent ceiling recesses.

7. A hood as set forth in claim 1, wherein said tiltable metallurgical vessel is a pig iron mixer and said opening is designed as a vertical slot extending along the path along which said pig iron mixer is tilted; and further including a wing movable along said vertical slot so as to cover said slot all around said lip.

* * * * *